US006397496B1

(12) United States Patent
Seymour

(10) Patent No.: US 6,397,496 B1
(45) Date of Patent: Jun. 4, 2002

(54) ARTICLE OF FOOTWEAR

(76) Inventor: Keahinuimakahahaikalani Howard Seymour, 61 Church Hill Road, Solihull, West Midlands B91 3JA (GB)

( * ) Notice: Subject to any disclaimer, the term of this patent is extended or adjusted under 35 U.S.C. 154(b) by 0 days.

(21) Appl. No.: 09/674,017

(22) PCT Filed: Dec. 8, 2000

(86) PCT No.: PCT/GB99/01245

§ 371 (c)(1),
(2), (4) Date: Nov. 22, 2000

(87) PCT Pub. No.: WO99/55185

PCT Pub. Date: Nov. 4, 1999

(30) Foreign Application Priority Data

Apr. 27, 1998 (GB) ..... 9808874

(51) Int. Cl.[7] ..... A43B 13/28

(52) U.S. Cl. ..... 36/27; 36/7.8; 482/77; 482/79

(58) Field of Search ..... 36/7.8, 27, 28; 482/77, 79

(56) References Cited

U.S. PATENT DOCUMENTS 1,613,538 A * 1/1927 Schad ..... 36/7.8
1,638,350 A * 8/1927 Long ..... 36/7.8
2,172,000 A * 9/1939 Wenker ..... 36/7.8
3,205,596 A * 9/1965 Hoffmeister
4,302,891 A * 12/1981 Gulli ..... 36/7.8
4,534,124 A * 8/1985 Schnell ..... 36/7.8
4,707,934 A * 11/1987 Hart ..... 36/7.8
4,887,370 A 12/1989 Okada
4,912,859 A * 4/1990 Ritts ..... 36/7.8
5,090,138 A 2/1992 Borden
5,701,685 A * 12/1997 Pezza ..... 36/7.8
5,826,350 A * 10/1998 Wallerstein ..... 36/7.8
5,896,679 A * 4/1999 Baldwin ..... 36/7.8
6,115,942 A * 9/2000 Paradis ..... 36/27
6,131,309 A * 10/2000 Walsh ..... 36/27

FOREIGN PATENT DOCUMENTS

CH 611138 A 5/1979

* cited by examiner

*Primary Examiner*—M. D. Patterson

(57) ABSTRACT

An article of footwear having a support structure in the form of a boot (10) a primary lever (22) being pivotally mounted adjacent the heel of the boot (10), the primary lever (22) extending downwardly below the sole formation (17) of the boot (10) and being biased away therefrom, by resilient means (38), and a secondary lever (26) being pivotally mounted adjacent the lower end of the primary lever (22) and being biased away from the sole formation (17) of the boot (10) by resilient means (34), the secondary lever (26) being pivotal relative to the first lever (22) towards the sole formation (17) against the biasing force of the resilient means (34), so that upon downward movement of the boot (10) the resilient means will be resiliently deformed storing energy which will assist motion of the boot in the upward direction.

27 Claims, 5 Drawing Sheets

ARTICLE OF FOOTWEAR

The invention relates to an article of footwear suitable for sporting or recreational activities.

Roller boots having wheels on the bottom have given rise to a popular sporting recreational activity over recent years. The present invention is directed towards providing a personal mode of transport which is suitable for use in recreational activities.

According to one aspect of the present invention an article of footwear having a support structure, the support structure defining a lower sole formation and an upper leg portion, characterised in that a primary lever is mounted to the support structure for movement about a primary pivot, the primary lever extending from the primary pivot below the sole formation of the support structure and being biased away therefrom by resilient means; and a secondary lever being pivotally mounted to the primary lever for movement about a secondary pivot, the secondary pivot being adjacent the lower end of the primary lever, the secondary lever extending downwardly from the secondary pivot and being biased away from the sole formation of the support structure by resilient means, the second lever being pivotal relative to the first lever towards the sole formation against the biasing force of the resilient means.

According to a preferred embodiment the article of footwear is used in pairs and may be formed integrally of a pair of boots or as an attachment for a pair of boots.

Such a pair of boots can assist the human running motion, and is powered by energy which is stored and subsequently released from the resilient means, which may typically be in the form of a spring.

According to a preferred embodiment of the invention the primary lever has first and second portions, the first portion extending to one side of the primary pivot downwardly below the sole formation of the support structure and the second portion extending to the opposite side of the pivot, the resilient means acting between the second portion of the primary lever and the leg portion of the support structure. In similar manner the secondary lever may have first and second portions, the first portion extending downwardly and resilient means acting between the second portion of the secondary lever and the primary lever or the support structure.

In a preferred embodiment the primary lever comprises two generally parallel limbs disposed one on each side of the support structure and the secondary lever comprises two or more generally parallel limbs, each pivotable about the first portion of the primary lever. Each limb of the secondary lever preferably has a secondary resilient means such as a spring coupled with the support structure or with the primary lever.

For the purposes of efficiency the resilient means may be coupled to the second portion of the primary lever by a pulley.

The tension of the resilient means may be adjustable, either manually or automatically by suitable means, for example tensioning levers or by pneumatic, hydraulic or electromechanical actuators.

In some embodiments, the boot may have a plurality of primary levers each primary lever having independent resilient means. In such embodiments, it is preferred that each primary lever has an independent secondary lever pivotal mounted thereon.

In order to vary the ground purchase according to the user 's ability, the splay of the secondary levers or the limbs of the primary lever or the or each secondary lever may be adjustable, that is, the width of separation of the secondary levers may be varied along the length of the levers.

In some embodiments either or both primary and secondary levers may be foldable or movable in order that the article of footwear may be used in a normal walking manner.

In some embodiments the primary lever may be directed in a downward direction rearwardly of the support structure.

The secondary lever may be straight or alternatively the first and second portions may be angled at, or adjacent, the secondary pivot at an angle of less than 180 degrees, such that the ends of the secondary lever contact the ground to provide the user with a stable base on which he or she might stand. The first and second portions of the secondary lever may be interconnected such that the included angle may be adjustable. The length of the second portion may also be adjustable, for example telescopic.

The movement of both the primary and secondary levers, the primary lever length and/or the point at which the resilient means is coupled to the leg portion of the support structure may be adjusted. Suitable means for adjustment may comprise ratchet winding, a one way pulley system or screw thread device for adjusting the tension of the primary and/or secondary resilient means.

The various components of the article of footwear may be comprised of carbon fibre composite. For example, the secondary lever may comprise carbon fibre composite which itself is flexible. Alternatively the secondary lever may be formed from sprung steel. The primary lever may comprise carbon fibre composite.

Additional levers may be used with the device. For example, a third lever may be used which may be positioned between the support structure and the primary lever, the third lever being pivotally attached to the support structure at one end and defining the primary pivot at the other end. Additional resilient means may act on said third lever. Additionally or alternatively an upper leg lever may be attached to the article of footwear pivoting in the knee and hip regions, and an upper leg spring may be positioned behind the upper leg or in a back pack manner. With the use of the upper leg lever, arm handles may be utilised, motion of which can increase the spring flexion or extension or may simply be used for sport.

The power of the article of footwear may be enhanced by the use of active components such as pneumatic, hydraulic or electrical means. These may be used directly on to the levers, or in conjunction with energy-saving springs by extending the length further than the normal extension so giving more stored energy or power. Sensors may be provided in the primary or secondary levers which activate the use of the active components. Alternatively, or additionally hand held switches may be used to switch on or off the active components. Such power assistance means my include energy storage means which may be charged by motion of the mechanism during use. For example movement of the primary lever may be used to pump fluid to a pneumatic or hydraulic pressure accumulator.

The article of footwear may be used in combination with a tail adaptation attached to one or more of the springs, or to the back of the wearer which acts both as a counter poise balance and as an energy store.

Sprung or weighted tails may be positioned on each article of footwear, the distance and/or weight of the tail being preferably adjustable for complying with the resonance for different running stages.

The article of footwear may have various adaptations to diversify the manner of usage. For example, roller skate wheels or ski attachments may be attached to the secondary levers. Alternatively or additionally water ski attachments, snowboard attachments, ice skate attachments or hydrofoil attachments may be used with the boot. Another adaptation comprises the use of large pneumatic wheels. In these applications the resilient means will act as shock absorbers.

The articles of footwear may be used in combination with the use of wings connected to the arms in order to prolong the stride or the jump into the air of the wearer.

Conveniently, articles of footwear are provided with a braking system. This may be provided by mean to gradually releasing tension in the resilient means, in a controlled manner.

The invention will now be described by way of example only, with reference to, and as shown in, the accompanying drawings in which.

Figure 1:
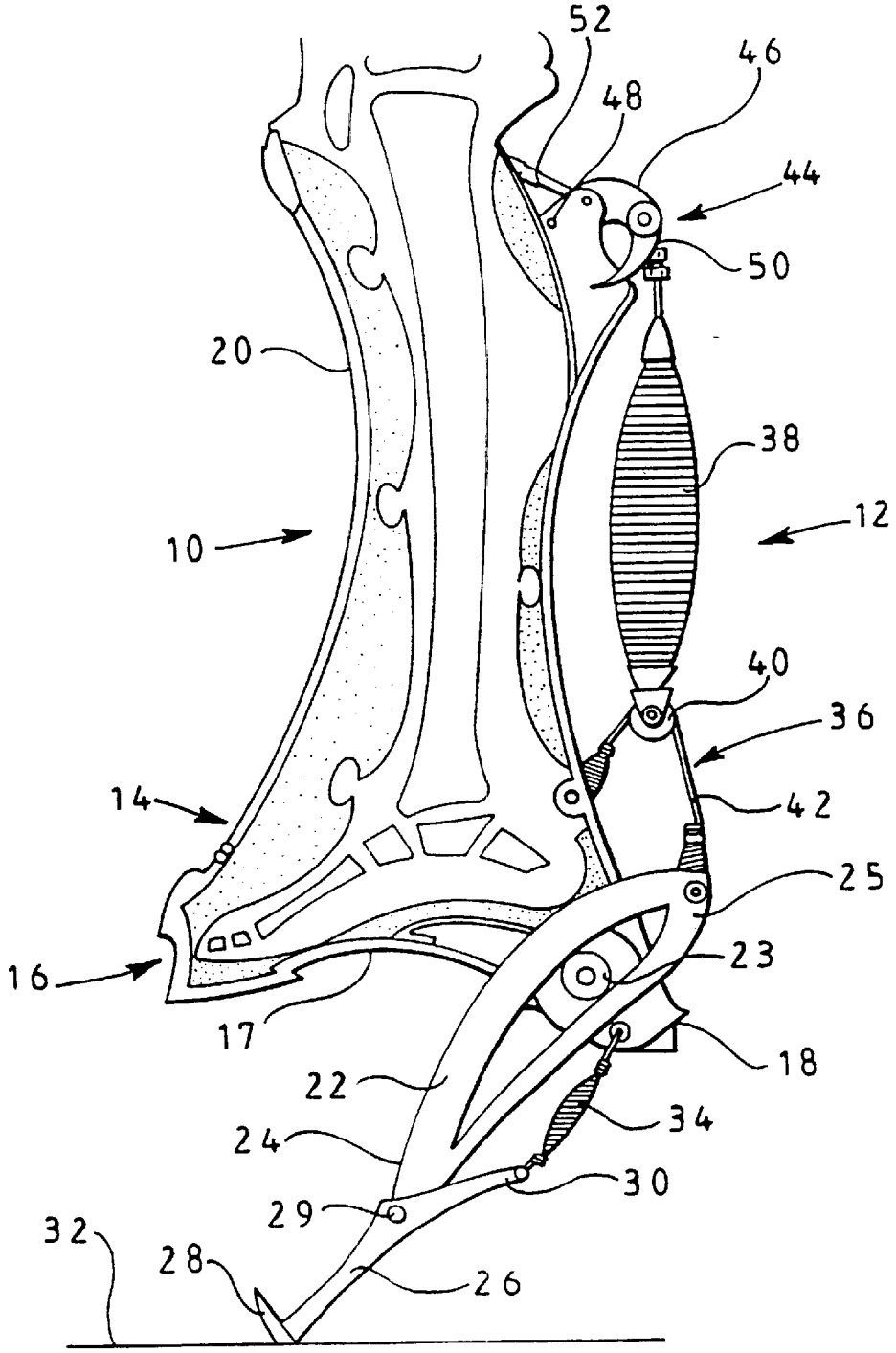
FIG. 1 represents a side view of a leg of a user wearing a preferred form of boot according to the present invention.
Figure 2:
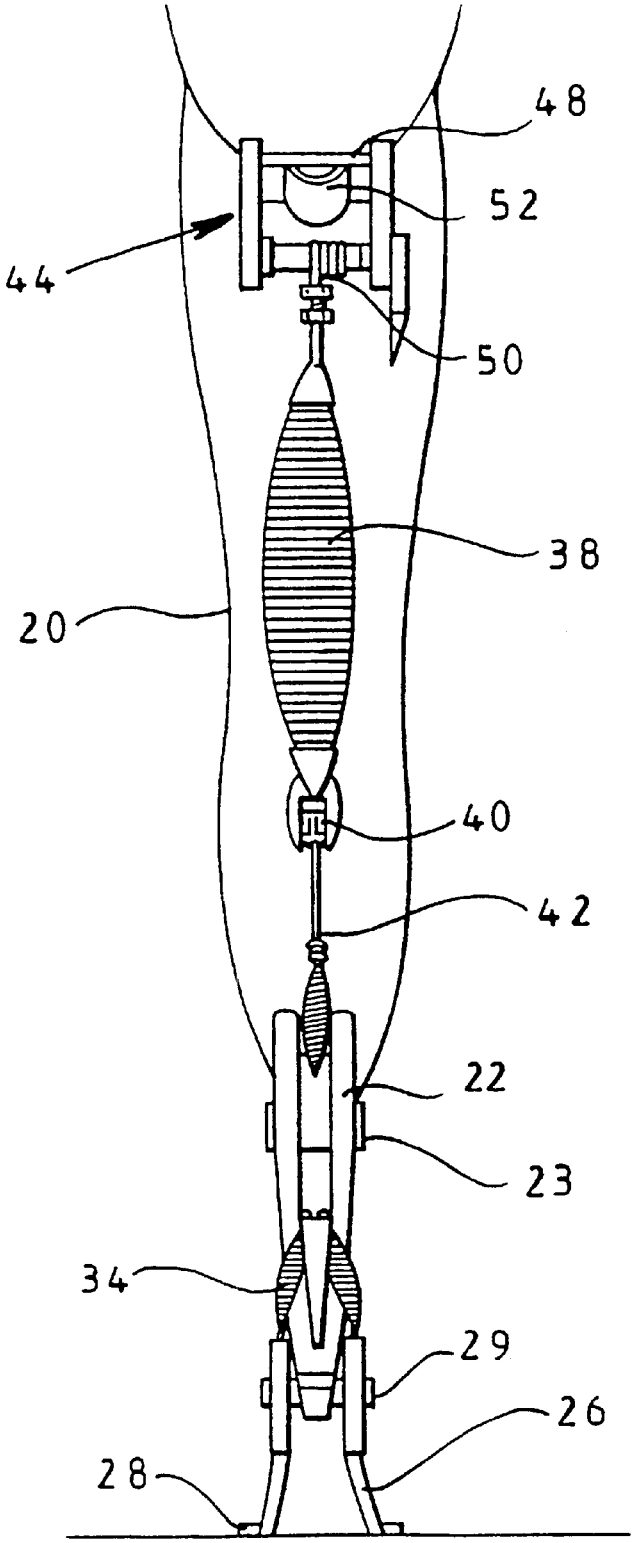
FIG. 2 shows a rear view of a leg of a user wearing the boot of FIG. 1.

Referring to FIGS. 1 and 2, these show an item of footwear in the form of a boot 10 which has a mechanism 12 for improving the mobility of a wearer.

The boot has a foot portion 14 with a toe region 16, a heel region 18 and a sole formation 17 defined therebetween, and a calf portion 20.

A first order lever 22 is pivoted intermediate its ends to the heel region 18, the lever 22 conveniently having two parallel limbs pivotally mounted to the heel region 18 about pivot 23, one limb to each side of the sole formation. The limbs are rigidly secured together.

The lever 22 has first and second ends 24,25. In this example, the first end 24 of the lever 22 lies below the level of the sole formation of the boot 10.

A second first order lever 26 is pivoted intermediate its ends to the first lever 22 about pivot 29, at or adjacent to the end 24. The lever 26 has a front end 28 and a rear end 30.

The front end 28 of the lever 26 is adapted to engage a ground surface 32 whilst a resilient means in the form of a coil spring 34 connects the end 30 of the lever 26 with the heel region 18, the result being that the lever 26 is biased in an anti-clockwise direction as seen in FIG. 1 to pivot the end 28 away from the toe region 16 of the boot 10.

The end 25 of the first lever 22 is coupled via a pulley system 36 and resilient means 38 to the rear of the calf portion 20 of the boot 10. The pulley system 36 has a single pulley 40 with one end of a cord 42 being attached to the rear of the foot portion of the boot 10 and the other end of the cord 42 being attached to the lever 22 at or adjacent the end 25.

The resilient means 38 is conveniently a coil spring having one end attached to the pulley 40 and the other end attached either directly or by way of a tensioning means 44 to the rear of the calf portion 20 of the boot 10, ideally adjacent an upper end of the calf portion 20.

The tensioning means 44 is a mechanism which enables the position of the upper end of the spring 38 to be adjusted, as a result of which the tension in the spring 38 can be varied for a particular angular position of the lever 22.

The tensioning mechanism 44 comprises a bracket 46 which is pivotally mounted at one end 48 to the boot 10 and is connected at 50 to the end of the spring 38. An adjustment means 52 connects the rear of the boot 10 to a location on the bracket 46 intermediate the points 48 and 50. The adjustment mechanism 52 can be of any suitable form and is typically a hydraulic piston/cylinder unit whose length can be varied in order to adjust the position of the connection point 50 on the bracket 46.

Alternatively, the adjustment mechanism 52 can be a simple screw-thread mechanism.

The arrangement is such that, as can be seen best in FIG. 1, the absence of any force acting on the end region 24 of the first lever 22, energy stored in the spring 38 will act to pivot the lever 22 anti-clockwise. Assuming that a wearer of the boot 10 has raised his leg to raise the boot 10 fully clear of the ground so that the second lever 26 is not in contact with the ground and then lowers his boot 10 to bring the lever 26 into contact with the ground, the action of the mechanism is as follows:

When the end 28 of the lever 26 contacts the ground, the lever 26 is pivoted in a clockwise direction, against the action of the spring 34. As the tension in the spring 34 increases, the tendency is for the lever 22 then to be pivoted in a clockwise direction about the heel region 18 of the boot 10 against the action of the spring 38.

As the wearer applies more weight to his leg, pivoting of the lever 22 continues, increasing the energy stored in the spring 38, until the boot 10 contacts the ground.

When the wearer then raises his leg from the ground, the energy stored in the spring 38 acts to assist this movement. The result of this assistance is that the wearer can take much greater strides than normal and can jump higher than normal, thus increasing his mobility.

Although the pulley system 40 is shown having a single pulley it will be appreciated that a more complex pulley system could be used.

Whilst tension springs 34,38 are shown as the preferred form of resilient means it will also be appreciated that any other suitable form of resilient means might be provided and it would be possible to modify the boot in a relatively simple manner to make use of compression springs.

As can be seen from FIG. 2, the lever 26 is preferably formed by two parallel limbs which splay out towards the end 28 for better stability.

Whilst both levers are shown having two limbs each, it will be appreciated that one or more than two limbs may be provided for either or both levers.

The lever 26 does provide a relatively stable base for the wearer to stand on and although shown as a straight lever could be angled at its pivot point with an included angle of less than 180 degrees such that when the wearer is in a standing attitude, the front and rear ends, 28,30 of the lever 26 contact the ground to provide a relatively stable base.

It will also be appreciated that the mechanism shown attached to the boot 10 could be secured in a reverse attitude i.e. the rear of the boot 10 as shown in FIG. 1 could in fact become the front of the boot 10 with the lever 22 pivoted on the toe region 16.

In another modification, the lever 22 could actually be angled rearwardly so that the first end 24 of lever 22 extended rearwardly and away from the toe region 16 of the boot 10.

Figure 3:
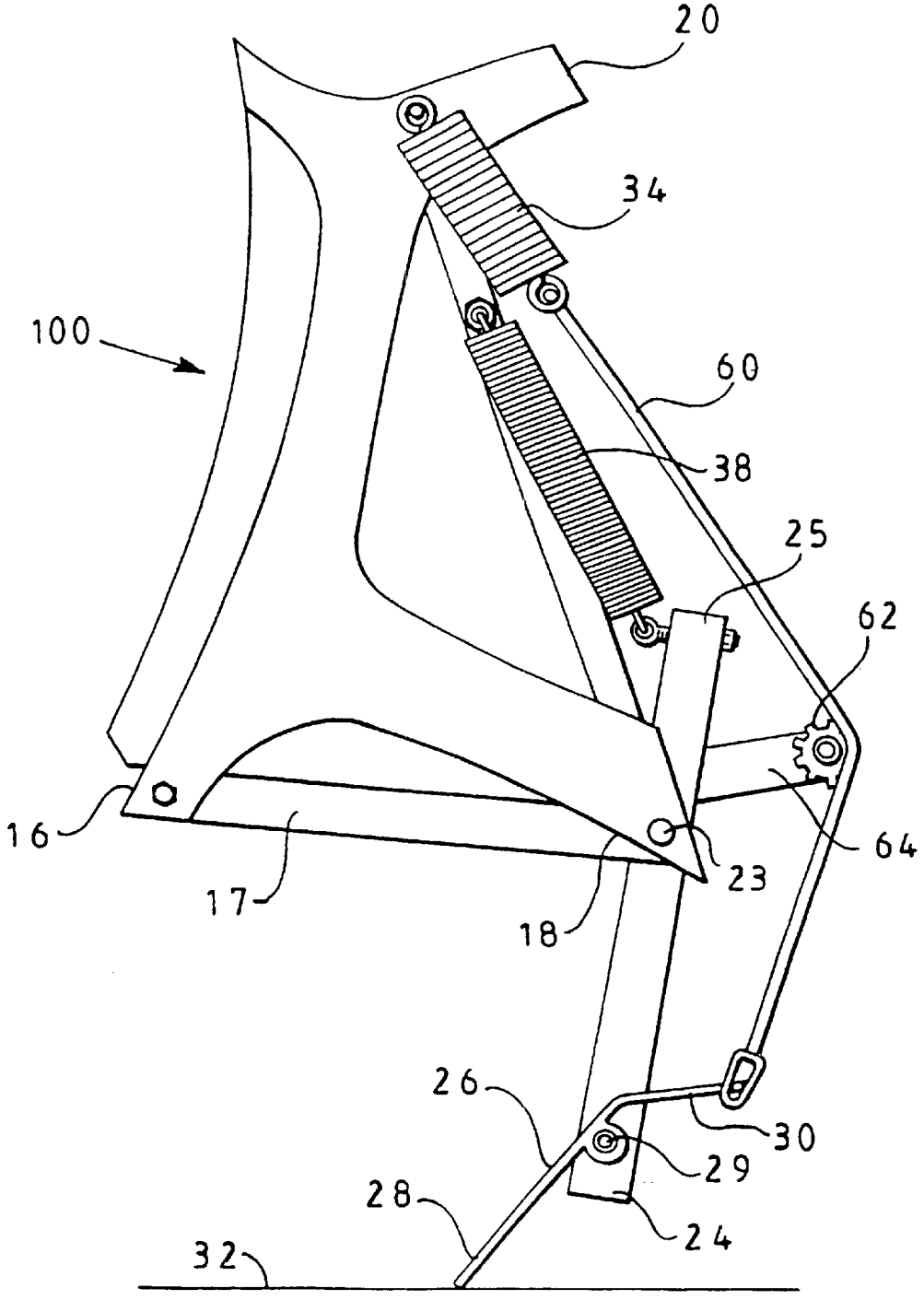
FIG. 3 shows in side elevation an alternative embodiment of the present invention.
Figure 4:
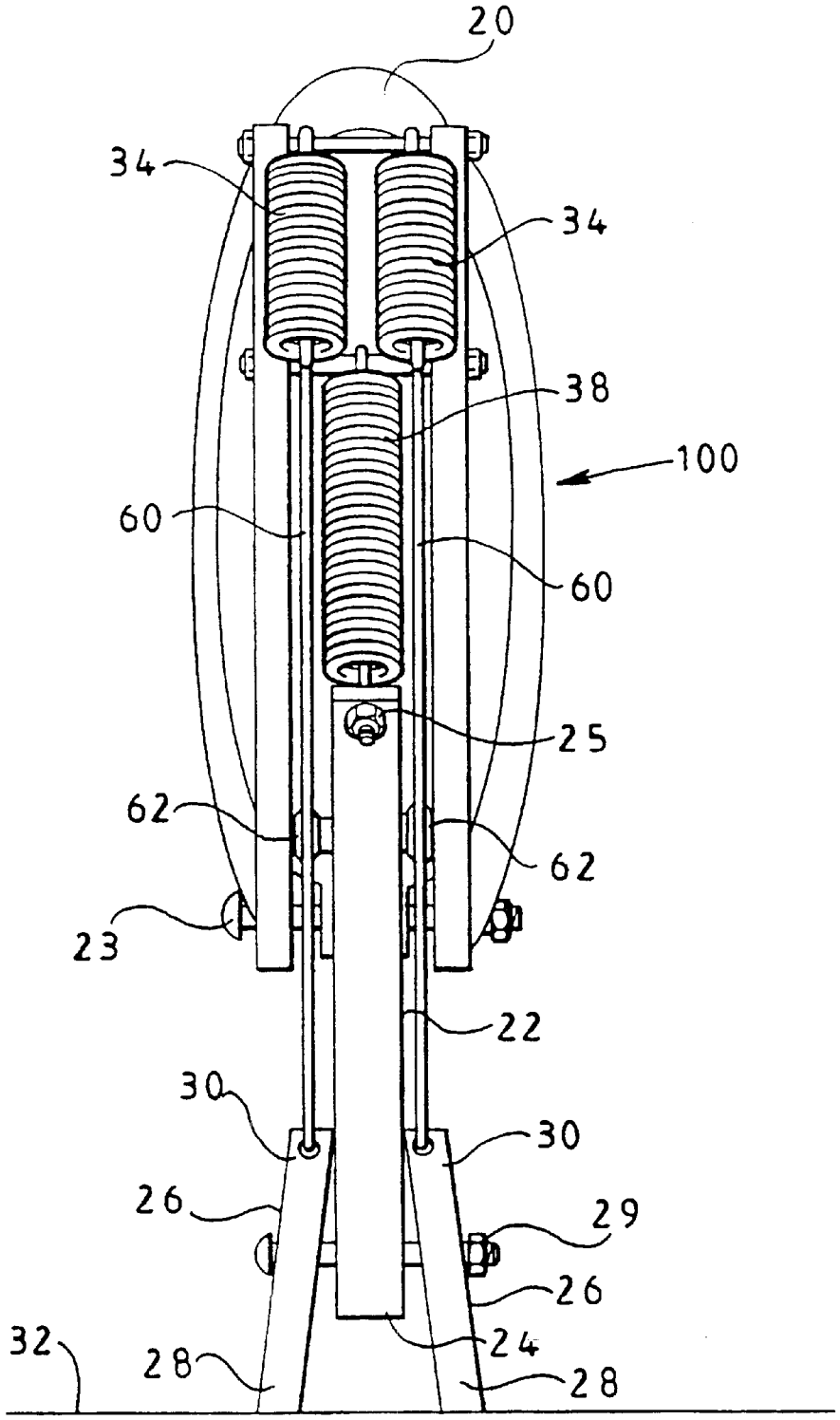
FIG. 4 shows a rear elevation of the embodiment illustrated in FIG. 3.
Figure 5:
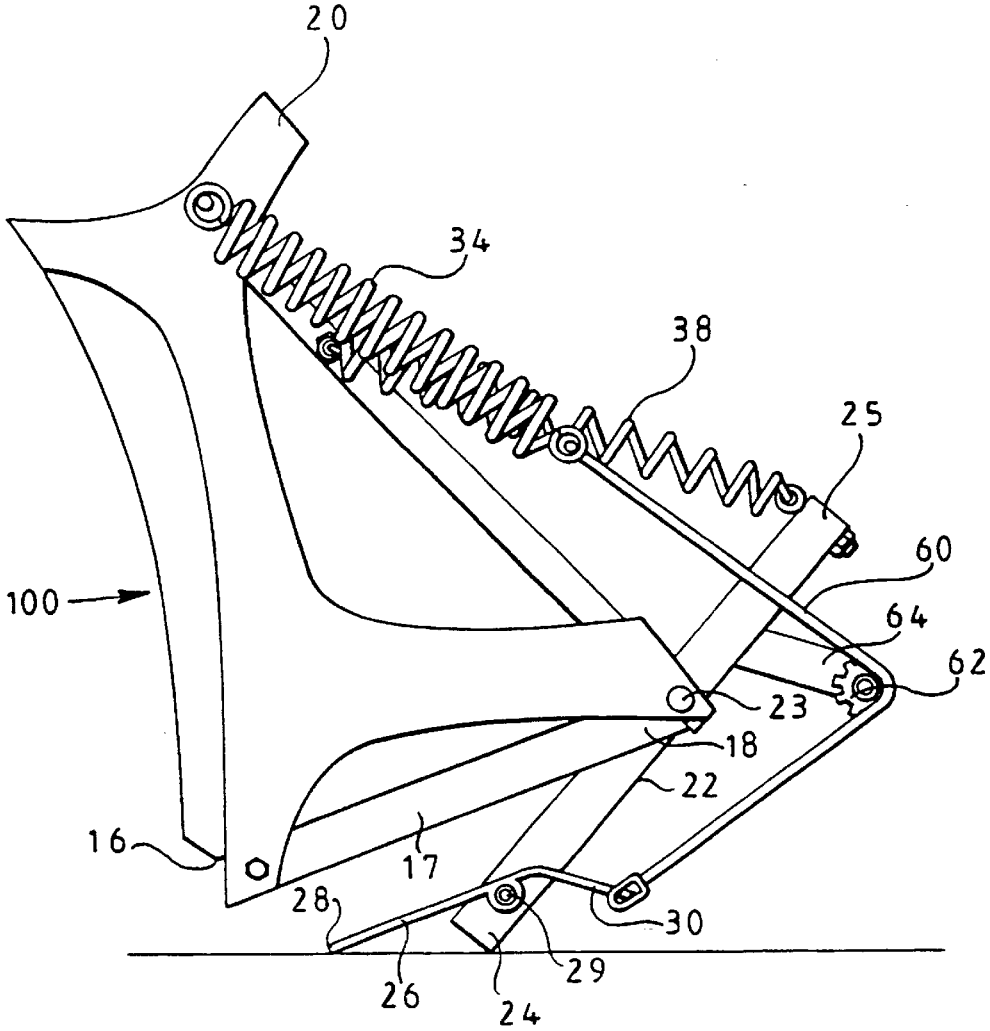
FIG. 5 shows a view similar to that of FIG. 3 with the mechanism fully compressed.

The embodiment shown in FIGS. 3 to 5 illustrates an attachment which may be secured to a boot, in suitable manner. The attachment comprises a support structure 100 defining a toe region 16, sole formation 17, heel region 18 and calf portion 20 similar to the boot 10 of the previous embodiment.

A one piece primary lever 22 is mounted to the heel region 18 of the support structure 100 about pivot 23. The primary lever 22 defines a first portion 24 extending to one side of the pivot 23 below the sole formation 17 of the support structure 100. A second portion 25 of the primary lever 22 extends to the opposite side of the pivot 23, a tension spring 38 acting between the end of this second portion 25 and the calf portion 20 of the support structure 100, to bias the first portion 24 of the primary lever 22 away from the sole formation 17.

A pair of secondary levers 26 are secured to the first portion 24 of primary lever 22 about pivot 29. The secondary levers 26 have first and second portions 28,30, the first portions 28 extending downwardly from the pivot 29 and the second portions 30 being attached to tension springs 34, by which first portions 28 of the secondary levers 26 are biased away from the sole formation 17 of the support structure 100. The springs 34 are secured to the support structure 100 adjacent the upper end of the calf portion 20, the springs 34 being attached to the levers 26 by lengths of chain 60, the lengths of chain being guided over sprockets 62 rotationally attached to the support structure 100 on a spur 64 located in the heal region 18 of the support structure 100. The secondary levers 26 are pivotal relative to the primary lever 22, so that the first portion 28 moves towards the sole formation 17, against the biasing force applied by springs 34.

The attachment shown in FIGS. 3 to 5 operates in the manner described above, the springs 34,38 being extended upon downward movement of the foot, as illustrated in FIG. 5, thereby storing energy which is released upon upward movement of the foot.

As with the embodiment described with reference to FIGS. 1 and 2 means may be provided in the attachment illustrated in FIGS. 3 to 5, for the automatic or manual adjustment of tension in the springs 34 or 38. Moreover the geometry and length of the various component may be adjustable as described above.

Various modifications may be made without departing from the invention, for example, while in the above embodiments coil tension springs are used, and suitable form of resilient means, such as tension or torsion springs or elasticated cord, may be used.

Furthermore interchangable components, for example secondary levers, may be provided to adapt the article of footwear for different terrains.

What is claimed is:

1. An article of footwear having a support structure (10; 100), the support structure (10; 100) defining a lower sole formation (17) having a toe region (16) and a heel region (18); and upper leg portion (20);

wherein a primary lever (22) is mounted on the support structure (10; 100) for movement about a primary pivot (23), the primary pivot (23) being located adjacent the heel region (18) and the primary lever (22) extending from the primary pivot (23) below the sole formation (17) of the support structure (10; 100) downwardly and towards the toe region (16) and being biased away therefrom by primary lever resilient means (38); and a secondary lever (26) being pivotally mounted to the primary lever (22) for movement about a secondary pivot (29), the secondary pivot (29) being adjacent the lower end of the primary lever (22), a first portion of the secondary lever (26) extending from the secondary pivot (29) downwardly and towards the toe region (16) and being biased away from the sole formation (17) of the support structure (10) by secondary lever resilient means (34), and the first portion of the secondary lever (26) being pivotal relative to the first lever (22) towards the sole formation (17) against the biasing force of the secondary lever resilient means (34).

2. The article of footwear according to claim 1, wherein the support structure (10) is formed integrally with a boot.

3. The article of footwear according to claim 1, wherein the article of footwear is an attachment for a boot, and means are provided for securing the support structure (100) to the boot.

4. The article of footwear according to claim 1, wherein the secondary lever (26) also has a second portion (30) which extend away from the first portion (28) and the secondary lever resilient means (34) acts upon the second portion (30) of the secondary lever (26).

5. The article of footwear according to claim 4, wherein the secondary lever resilient means (34) acts between the second portion (30) of secondary lever (26) and the support structure (10;100).

6. The article of footwear according to claim 5, wherein the secondary lever resilient means (34) acts between the second portion (30) of the secondary lever (26) and a heel region (18) of the support structure (10).

7. The article of footwear according to claim 4, wherein the secondary lever resilient means (34) acts between the second portion (30) of the secondary lever (26) and the primary lever (22).

8. The article of footwear according to claim 1, wherein means (44) is provided for adjustment of a tension of at least one of the primary lever resilient means (38) associated with the primary lever (22) and the secondary lever resilient means (34) associated with the secondary lever (26).

9. The article of footwear according to claim 8, wherein a tensioning lever is provided for manual adjustment of a tension of at least one of the primary lever resilient means (38) and the secondary lever resilient means (34).

10. The article of footwear according to claim 8, wherein means (44) is provided for automatic tensioning of at least one of the primary lever resilient means (38) and the secondary lever resilient means (34).

11. The article of footwear according to claim 10, wherein the means (44) for automatic tensioning of at least one of the primary lever resilient means (38) and the secondary lever resilient means (34) includes one of a pneumatic actuator, a hydraulic actuator and an electromechanical actuator.

12. The article of footwear according to claim 1, wherein means is provided for power assistance of at least one of the primary lever resilient means (38) and the secondary lever resilient means (34).

13. The article of footwear according to claim 12, wherein power assistance of at least one of the primary lever resilient means (38) and the secondary lever resilient means (34) is one of pneumatic means, hydraulic means and electric means.

14. The article of footwear according to claim 12, wherein the article of footwear stores energy for later released, when required, to provide the power assistance.

15. The article of footwear according to claim 14, wherein movement of the mechanism, during use, facilitates charging of a power source which is later released when required.

16. The article of footwear according to claim 12, wherein sensors are provided to provide the power assistance when required.

17. The article of footwear according to claim 12, wherein the power assistance is controlled manually.

18. The article of footwear according to claim 1, wherein at least one of the primary lever (22) and the secondary lever (26) has an adjustable length.

19. The article of footwear according to claim 1, wherein at least one of the primary lever (22) and the secondary lever (26) has an adjustable geometry.

20. The article of footwear according to claim 1, wherein at least one of the primary lever (22) and the secondary lever (26) comprises a series of parallel limbs.

21. The article of footwear according to claim 20, wherein the series of parallel limbs are independently sprung.

22. The article of footwear according to claim 1, wherein means is provided to counter poise the article of footwear during use thereof.

23. The article of footwear according to claim 1, wherein the secondary lever (26) is connectable to one of a roller skate, a ski, a water ski, a snowboard, an ice skate, a hydrofoil attachment and a wheel.

24. An article of footwear having a support structure (10; 100), the support structure (10; 100) defining a lower sole formation (17) and upper leg portion (20);

wherein a primary lever (22) is mounted on the support structure (10; 100) for movement about a primary pivot (23), the primary lever (22) extending from the primary pivot (23) below the sole formation (17) of the support structure (10; 100) and being biased away therefrom by primary lever resilient means (38); and a secondary lever (26) being pivotally mounted to the primary lever (22) for movement about a secondary pivot (29) and a remote end portion (28) of the secondary lever (26) being biased away from the sole formation (17) of the support structure (10) by secondary lever resilient means (34), and the secondary lever (26) being pivotal relative to the first lever (22) towards the sole formation (17) against the biasing force of the secondary lever resilient means (34);

the primary lever (22) has first and second portions (24, 25), and the first portion (24) of the primary lever (22) extends from one side of the primary pivot (23), downwardly below the sole formation (17) of the support structure (10;100) and the second portion (25) of the primary lever (22) extends from the opposite side of the primary pivot (23), and the primary lever resilient means (38) acts between the second portion (25) of the primary lever (22) and the leg portion (20) of the support structure (10;1 00).

25. The article of footwear according to claim 24, wherein the primary lever resilient means (38) is connected to the primary lever (22) by a pulley system (40).

26. An article of footwear having a support structure (10; 100), the support structure (10; 100) defining a lower sole formation (17) and upper leg portion (20);

wherein a primary lever (22) is mounted on the support structure (10; 100) for movement about a primary pivot (23), the primary lever (22) extending from the primary pivot (23) below the sole formation (17) of the support structure (10; 100) and being biased away therefrom by primary lever resilient means (38); and a secondary lever (26) being pivotally mounted to the primary lever (22) for movement about a secondary pivot (29) and a remote end portion (28) of the secondary lever (26) being biased away from the sole formation (17) of the support structure (10) by secondary lever resilient means (34), and the secondary lever (26) being pivotal relative to the first lever (22) towards the sole formation (17) against the biasing force of the secondary lever resilient means (34);

the secondary lever (26) has first and second portions (28, 30), and the first portion (28) of the secondary lever (26) extends downwardly and the secondary lever resilient means (34) acts upon the second portion (30) of the secondary lever (26); and the secondary lever resilient means (34) acts between the second portion (30) of the second lever (26) and the leg portion (20) of the support structure (100).

27. The article of footwear according to claim 26, wherein the secondary lever resilient means (34) is connected to the second portion (30) of the secondary lever (26) by a length of chain (60), and the chain (60) is guided over a sprocket (62) mounted adjacent a heel region (18) of the support structure (100).

* * * * *